US006698460B2

(12) United States Patent
Marsche

(10) Patent No.: US 6,698,460 B2
(45) Date of Patent: Mar. 2, 2004

(54) STRAPPING UNIT HAVING REPLACEABLE WEARING PARTS

(75) Inventor: Bernd Marsche, Uster (CH)

(73) Assignee: Orgapack GmbH, Dietikon (CH)

( * ) Notice: Subject to any disclaimer, the term of this patent is extended or adjusted under 35 U.S.C. 154(b) by 4 days.

(21) Appl. No.: 10/151,296

(22) Filed: May 21, 2002

(65) Prior Publication Data

US 2002/0179173 A1 Dec. 5, 2002

(30) Foreign Application Priority Data

May 21, 2001 (CH) ..... 0947/01

(51) Int. Cl.[7] ..... B21F 9/02
(52) U.S. Cl. ..... 140/93.2; 140/150
(58) Field of Search ..... 140/93 R, 93.2, 140/123.5, 123.6, 150, 152

(56) References Cited

U.S. PATENT DOCUMENTS 4,155,382 A * 5/1979 Bachmann et al. ..... 140/93.2
5,518,043 A * 5/1996 Cheung et al. ..... 140/93.2
6,016,728 A * 1/2000 Bohl ..... 7/139

FOREIGN PATENT DOCUMENTS

CH 477955 A 9/1969
GB 707418 A 4/1954

* cited by examiner

*Primary Examiner*—Lowell A. Larson
(74) *Attorney, Agent, or Firm*—Lowe Hauptman Gilman & Berner LLP

(57) ABSTRACT

A strapping unit for wrapping a tightening strap around a packaged item has a base plate, a tensioning device, a sealing device and a separating device. The tensioning device is provided with an actuable tensioning tool being fastened releaseably to the strapping unit by at least one fastening element. The sealing device is provided with a single- or multi-part sealing tool being fitted on the strapping unit by at least one releaseable, further fastening element. The separating device has a blade which can be brought into contact with the strap. At least part of the separating device is fitted releaseably on the strapping unit by at least one further, releaseable fastening element. The fastening elements are of a design which enables the fastening elements to be actuated by the same tool. Worn parts can therefore be swapped with very little maintenance effort.

12 Claims, 7 Drawing Sheets

STRAPPING UNIT HAVING REPLACEABLE WEARING PARTS

FIELD OF THE INVENTION

The invention relates to a strapping unit for wrapping a tightening strap around a packaged item.

BACKGROUND OF THE INVENTION

Such a strapping unit has a base plate which is provided with a supporting surface for arranging on a packaged item, the strapping unit furthermore has a tensioning device with which a strap tension can be applied to the tightening strap, for which purpose the tensioning device is provided with an actuable tensioning tool which can be brought into contact with the strap, the tensioning tool being fastened releasably to the strapping unit by at least one fastening means, also has a sealing device, which sealing device is provided with a single- or multi-part sealing tool with which two strap layers can be connected permanently to each other by contact with the strap, the sealing tool being fitted on the strapping unit by at least one releasable, further fastening means, the strapping unit is furthermore provided with a separating means with which the strap can be severed, for which purpose the separating means has a blade which can be brought into contact with the strap, at least part of the separating means being fitted releasably on the strapping unit by at least one further, releasable fastening means.

Strapping units of this type are frequently provided for mobile use so that a user can wrap a steel strap around a packaged item in any desired location. A first generic type of these strapping units typically has a sealing device which produces a connection of two layers of the steel strap by means of multiple notchings, without using an additional sealing element, such as, for example a lead seal. For this type of strapping unit it is also typical for both the strap tension and the formation of a seal to be produced manually without the assistance of outside energy, in particular electric or pneumatic energy. For this purpose, the operator of a strapping unit according to the generic type has only to provide his own muscular power. However, the invention is also suitable for another generic type of strapping unit, in which either a sealing element, such as the already mentioned lead seal, or auxiliary energy, such as, for example, electric or pneumatic energy, is used for producing a welding connection in the case of plastic straps.

However, a common feature of the described generic types of strapping units is that, as a rule, the required strap tension is applied to the strap by means of a rotating tensioning wheel. By means of a frictional lock between the tensioning wheel and the strap layer in contact with it, the strap layer can be moved in the direction of a supply reel of the strap, as a result of which the strap loop becomes smaller and the strap tension consequently becomes greater. Apart from the manually actuated tensioning devices which have already been discussed, tensioning devices which use electric, pneumatic or other auxiliary energy for producing the strap tension can also be provided in strapping units of the generic type.

Virtually all of the components which belong to strapping units of this type and are in contact with the strap are subject to wear. In particular, those components whose function is to act upon the strap, whether by means of friction, a frictional lock or by deformation of the strap, regularly wear out. Consequently, such worn parts have to be regularly replaced. In the case of the described, previously known strapping units, what may not be satisfactory in this connection is that a great maintenance effort is required in order to replace the worn parts.

SUMMARY OF THE INVENTION

The invention is therefore based on the object of providing a strapping unit in which worn parts can be swapped with as little maintenance effort as possible.

This object is achieved according to the invention in the case of a strapping unit of the type described at the beginning by it being possible for a plurality of worn parts of the strapping unit to be exchanged using the same, i.e. using just one, tool. According to the invention, fastening means of the worn parts are therefore intended to be of a design, at the points provided for engagement of the tool, which enables the said fastening means to be released and fitted using just one tool in total. According to the invention, it is intended, in particular, for it to be possible at least for the worn parts on the strapping unit to be released with the same tool, swapped for new parts and for the latter to be fastened again using the same tool, wherein it is conceivable that they can be swapped regularly on the one hand, and simultaneously, on the other hand. This may involve one or more worn parts of the sealing device and/or of the separating means. This may, for example, comprise a die-plate and a punch of a notching tool of the sealing device, which tool is provided for sealing a strap loop, and a blade of the separating means. Instead of one of the abovementioned worn parts, or in addition thereto, a tensioning wheel of the tensioning device may also be provided and can likewise be replaced using the same tool.

The invention is therefore based on the concept of simplifying the maintenance effort by reducing the required handling steps and reducing the number of tools to be stocked up on. In the most favorable case, just one single tool which, if possible, is to be a standard tool, is required for the replacement of all of the worn parts. The strapping unit and the tool suitable for it can also be understood to be the maintenance system. Since strapping units are generally used in industrial works in which standard tools of this type are present, virtually all over the world the maintenance work can be undertaken by the user himself. Particularly in the case of mobile, transportable strapping units, this affords the advantage that worn parts can be exchanged very rapidly by the user himself in situ without the service of the unit manufacturer or a workshop being required for this purpose.

The ease of maintaining strapping units according to the invention can be further increased if worn parts or their fastening means on the strapping unit are accessible from the outside. According to the invention, fastening means of the worn parts should be able to be released without other components connected to the corresponding worn part having to be removed for this. For example, coverings or components which are retained or clamped by the same fastening element are connected to the worn part. In particular, components of the strapping unit with which movements of the strapping unit are produced, for example shafts and levers, and which would have to be readjusted again after the swapping of the worn parts should not have to be removed.

In a preferred embodiment, the tool can be just one screwdriver of a certain size, for example of size 4. Of course, other tools could also be provided, such as, for example, a spanner or the like.

Further preferred refinements of the invention emerge from the dependent claims, the description of the figures and the drawing.

BRIEF DESCRIPTION OF THE DRAWINGS

The invention will be explained in greater detail with reference to exemplary embodiments illustrated schematically in the figures, in which.

DETAILED DESCRIPTION OF THE INVENTION

Figure 1:
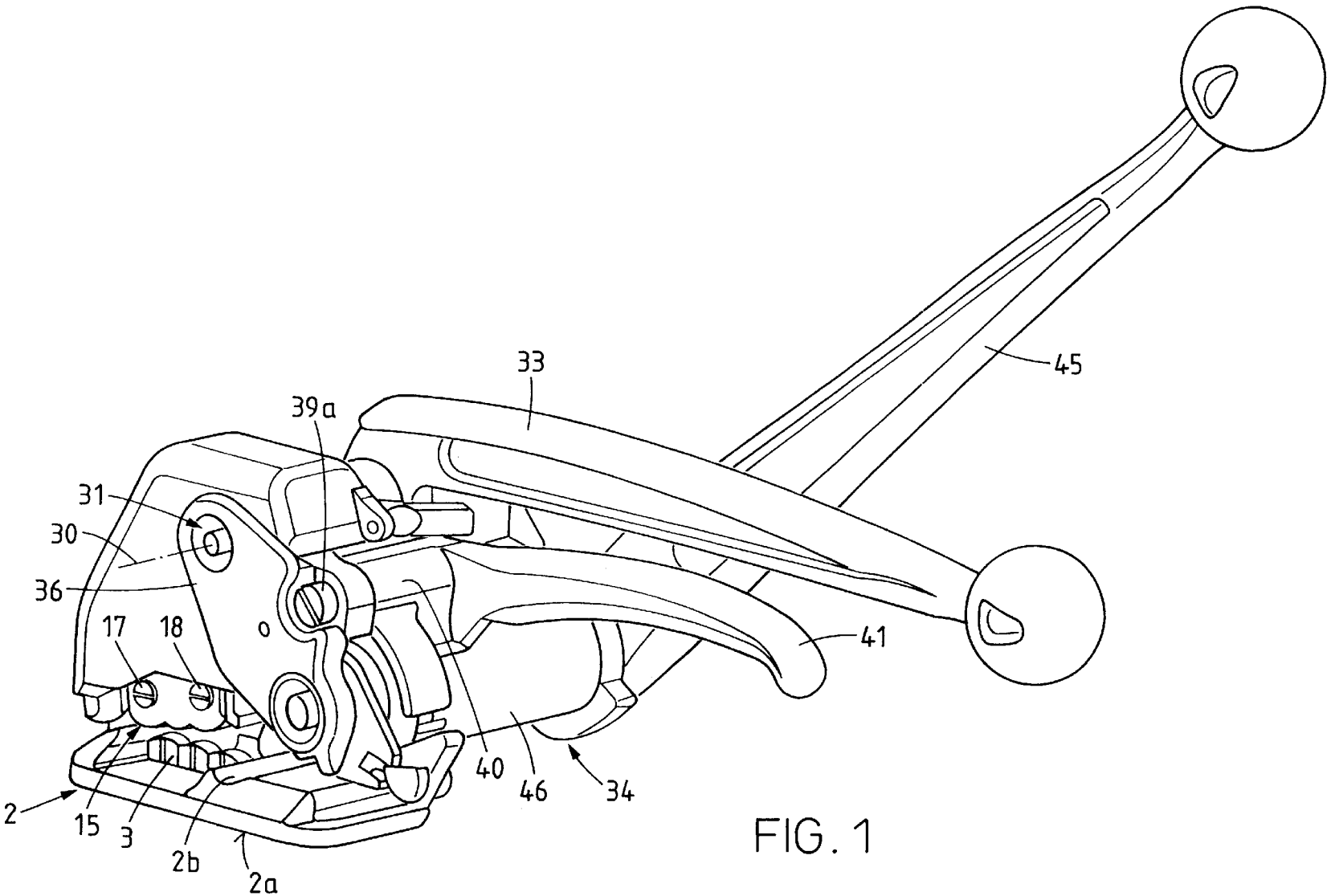
FIG. 1 shows a perspective illustration of a strapping unit according to the invention.
Figure 2:
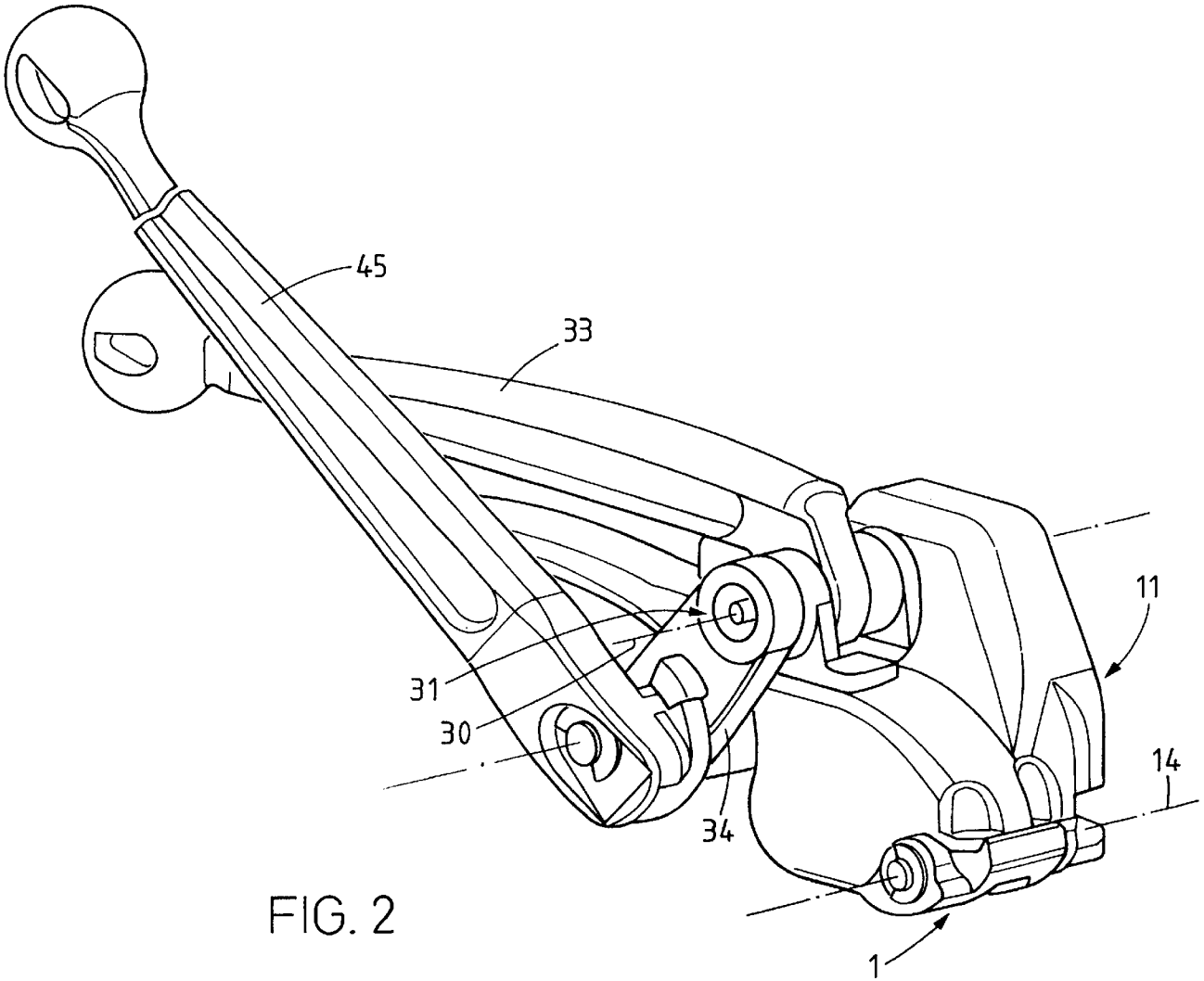
FIG. 2 shows the strapping unit from FIG. 1 in a different perspective illustration.

In FIGS. 1 and 2 an exclusively manually actuated, portable handling unit is illustrated. With the strapping unit, a strap loop which is placed around a packaged item can be tensioned, sealed and separated from a strap supply reel.

Figure 7:
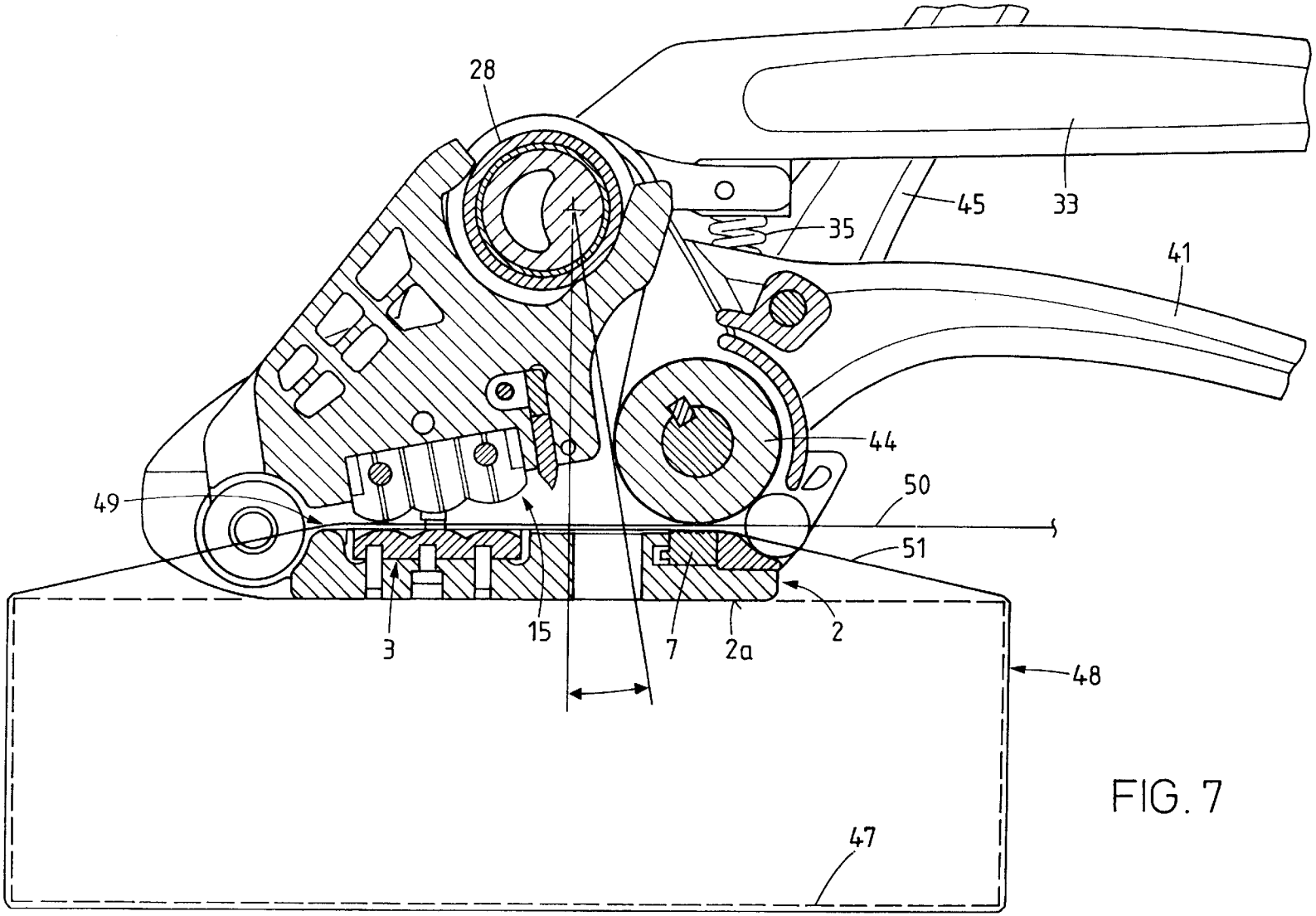
FIG. 7 shows a longitudinal sectional illustration of the strapping unit from FIG. 1 during the wrapping of a packaged item.

The strapping unit has, as a constituent part of a carrier 1, a base plate 2 with whose lower supporting surface 2*a* the strapping unit can be arranged on a package item, which is shown purely schematically only in FIG. 7. As can be gathered in particular from FIGS. 3*a* and 3*b*, a punch 3 in the base plate 2 is inserted into a recess of the base plate 2 from above. The punch 3 is fastened to the base plate by means of at least one slotted screw 4, which is introduced from the supporting surface 2*a* of the base plate 2, and two bolt pins 5, which are seated fixedly in the base plate. The punch 3 is a constituent part of a sealing device. A bearing surface 2*b* of the base plate 2 is provided directly behind the punch, in the direction of the rear end of the base plate. Finally, in the region of the rear end of the base plate a toothed plate 7, which is profiled on an upper side, is inserted into the base plate and a retaining plate 8 bears against it. The retaining plate 8 is likewise fastened releasably on the base plate 2 from the supporting side 2*a* with two slotted screws 9, 10 (FIGS. 3*a*, 4) and therefore fixes the toothed plate 7 in place. A slot width and slot depth of the heads of the slotted screws 4, 9, 10 are designed identically.

Figure 3A:
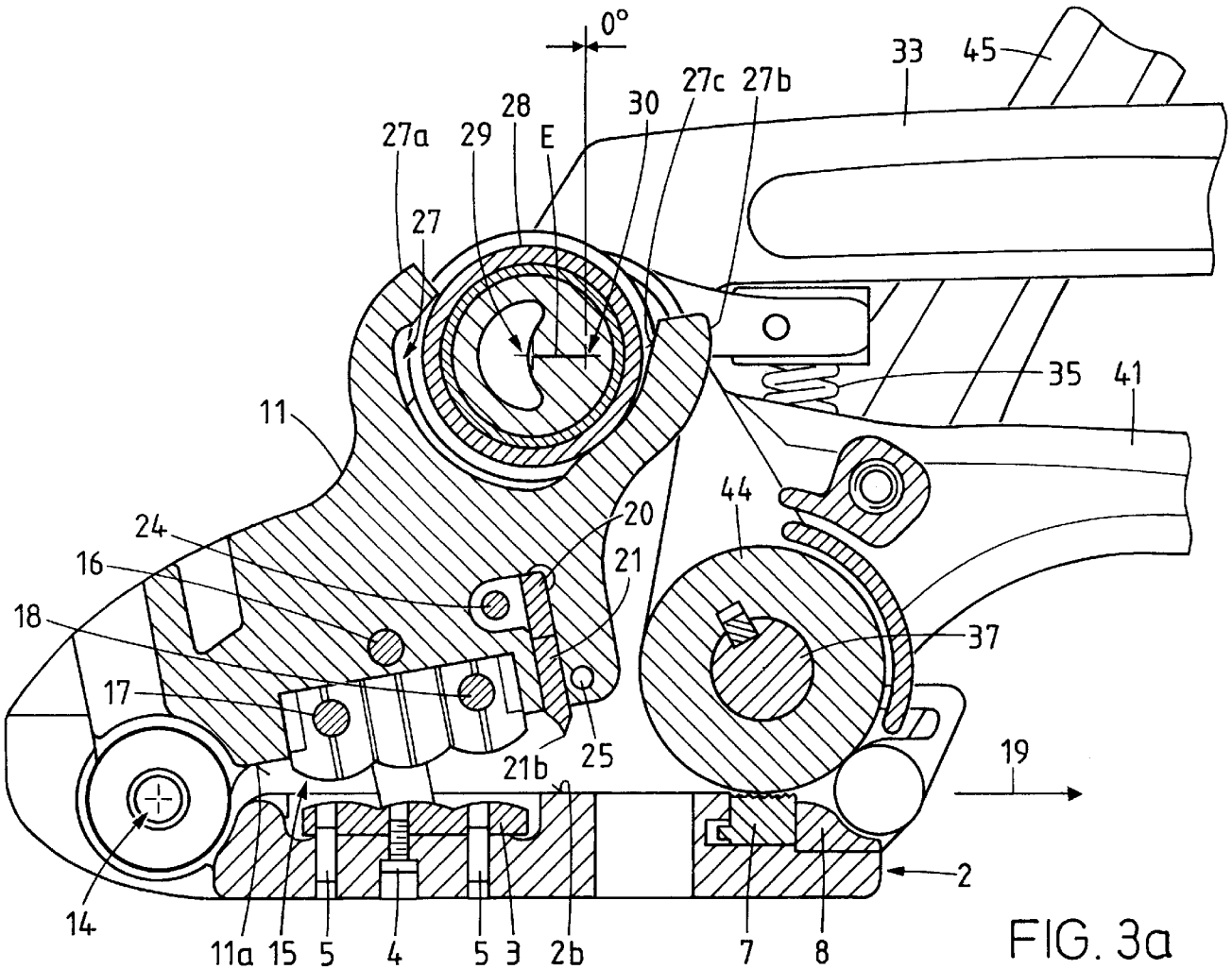
FIG. 3*a* shows a longitudinal sectional illustration of the strapping unit from FIG. 1, in which the sealing-device lever is situated in an open end position.
Figure 5:
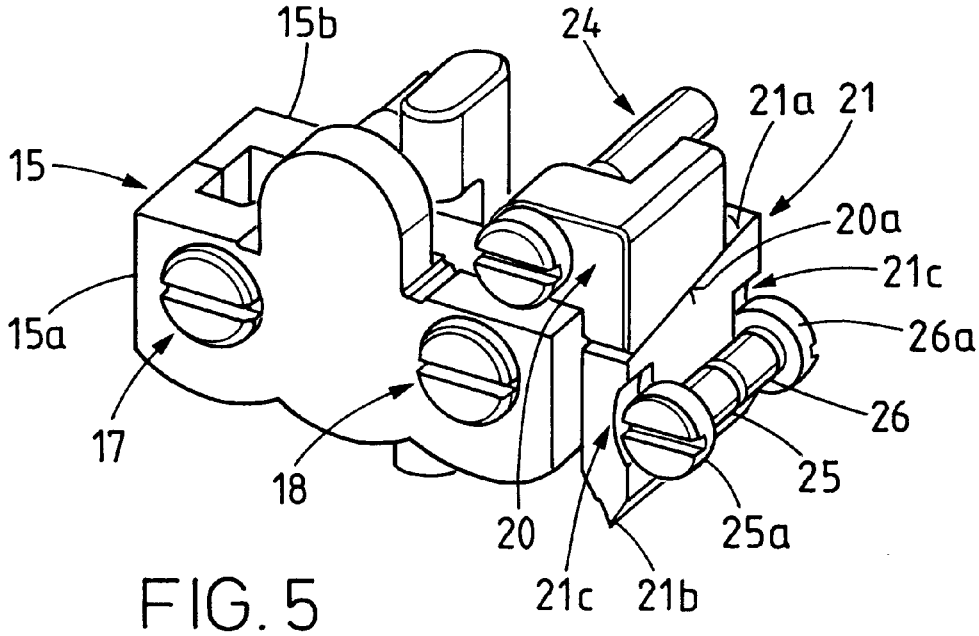
FIG. 5 shows a perspective illustration of a die-plate and a separating device of the strapping unit from the front.
Figure 6:
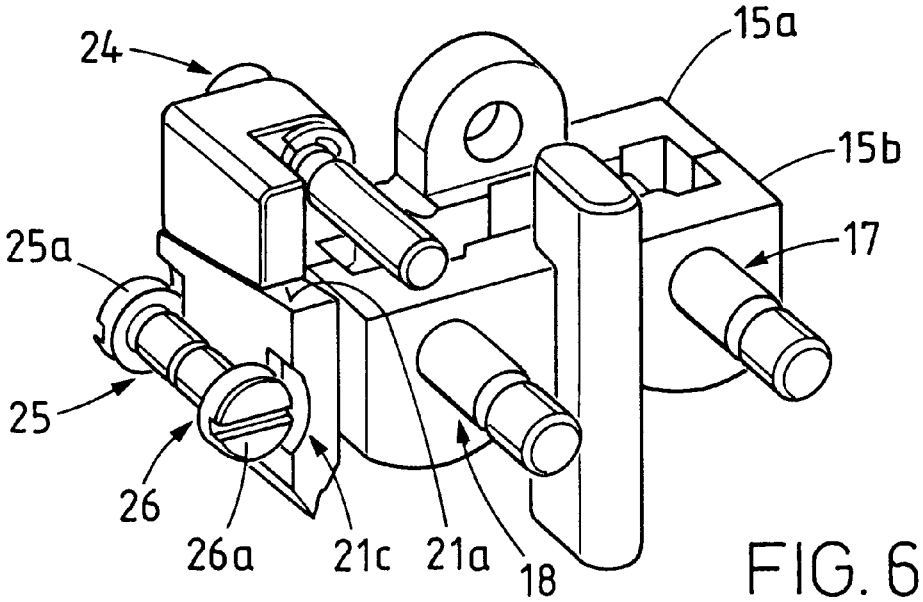
FIG. 6 shows a perspective illustration of the die-plate and the separating device from FIG. 5 from the rear.

In the region of a front end of the base plate, a die-plate carrier 11 is mounted on the bearing point of the carrier 1 in a manner such that it can pivot about a bearing axis 14 (FIGS. 2 and 3*a*). The die-plate carrier 11 can be pivoted between an open end position and a sealing end position and is a constituent part, inter alia, of a sealing device. The die-plate carrier has a two-part die-plate 15 shown in FIGS. 5 and 6. In the illustration of FIG. 3*a*, only the front die-plate part 15*a* of the two die-plate parts 15*a*, 15*b* can be seen. As FIG. 3*a* shows, the die-plate 15 is inserted into a recess on a lower side 11*a* of the die-plate carrier 11, which side faces the base plate. In order to secure the die-plate 15, the latter is pushed onto a pin 16 of the die-plate carrier 11 and is screwed to the die-plate carrier 11 by means of two identical slotted screws 17, 18 (FIGS. 1, 3*a*, 5). A slot width and slot depth of the heads 17*a*, 18*a* of the two screws 17, 18 are identical with the slot width of the screw heads 4, 9, 10.

Geometrical shapes of the die-plate 15 and of the punch 3 can be designed essentially corresponding to the sealing tools shown in DE 38 41 489 C2 or CH 659 221 A5.

A separating device, which is provided with an adjusting wedge 20 and a notching blade 21 as notching tool, is also arranged on the lower side 11*a* of the pivotable die-plate carrier, behind the die-plate 15 in the tensioning direction (arrow 19 in FIG. 3*a*). As can be seen in the detailed illustration of FIGS. 5, 6, the adjusting wedge 20 is provided with an obliquely running adjusting surface 20*a*. The adjusting wedge 20 is pushed into a recess of the die-plate carrier 11 (cf. FIG. 3*a*). Its insertion depth, which runs transversely with respect to the strap alignment, can be infinitely variably adjusted by an adjusting screw 24. For this purpose, the adjusting screw 24, which is accessible from the side of the strapping unit, engages in a thread of the die-plate carrier 11.

The notching blade 21 is likewise pushed into the die-plate carrier 11 below the adjusting wedge 20 and is clamped in place there by two identical slotted screws 25, 26. An oblique contact surface 21*a* of the blade lies opposite the adjusting surface. The inclination of the contact surface 21*a* corresponds to the inclination of the adjusting surface 20*a*, as a result of which both surfaces 20*a*, 21*a* bear against each other. On its side facing the base plate 2, the blade 21 has a notched cutter 21*b*. The blade 21 is also provided with two lateral grooves 21*c* which are approximately in the shape of a circular arc and in which a screw head 25*a*, 26*a* is arranged in each case. By this means, the blade 21 bears, firstly, against circumferential surfaces of the screw heads 25*a*, 26*a* of the two screws. Secondly, the two screw heads 25*a*, 26*a*, which act as stops, also define, in the direction of the insertion depth of the blade 21, the position of the said blade in the die-plate carrier 11. The same screwdriver which also matches the other screws 4, 9, 10, 17, 18 can be used to actuate the slotted screws 24, 25. By this means, a notched cutter 21*b* of the notching blade can protrude by a predetermined length over the lower side 11*a*. This projecting length can be adjusted in an infinitely variable manner by means of screw-in depths of the screws 24, 25, particularly as a function of the wearing state of the blade 21 and of the positions of the surfaces with which the punch 3 and the die-plate 15 deform the strap.

Figure 3B:
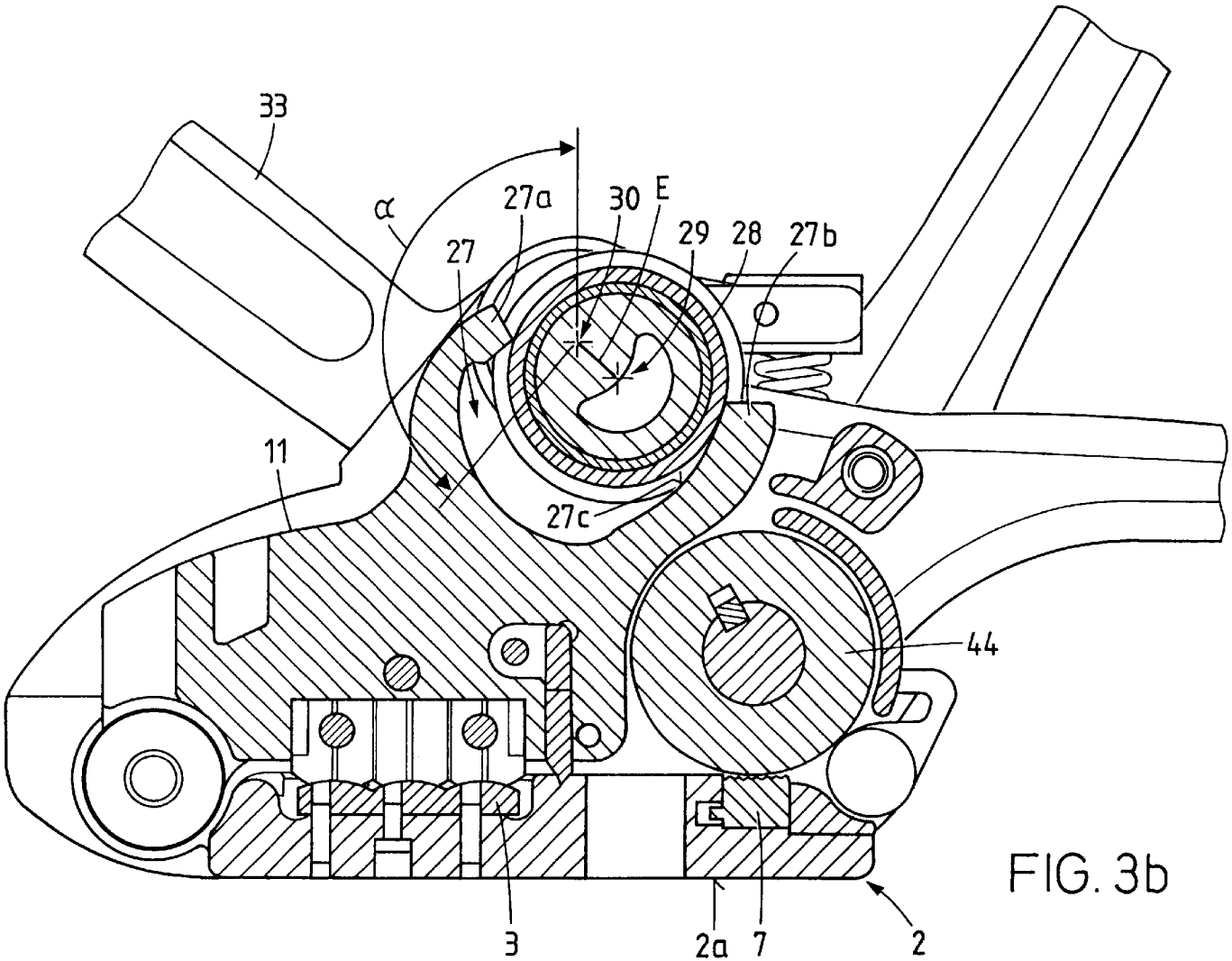
FIG. 3*b* shows an illustration of the strapping unit according to FIG. 3*a*, in which the sealing-device lever is shown in the sealing end position.

On an upper side facing away from the base plate 2, the die-plate carrier 11 has a receptacle 27 for a transmission element 28 (FIGS. 3*a*, 3*b*). For this purpose, the receptacle 27 is of approximately fork-shaped design, the two fork struts 27*a*, 27*b* being bent toward each other in each case. That fork strut 27*b*, which is closer to the rear end of the base plate 2, is provided with an inner rolling surface 27*c* which is shaped in such a manner that the transmission element 28 can roll on it for a certain distance during a pivoting movement of the die-plate carrier 11. The shape of the other fork strut 27*a* is configured to the effect that the transmission element 28 can, on the one hand, move in the predetermined manner in the receptacle 27 during pivoting movements, but, on the other hand, is retained securely between the two fork struts 27*a*, 27*b*.

In the exemplary embodiment illustrated, the transmission element 28 is a roller which is arranged eccentrically with its eccentric axis 29 with respect to a rotational axis 30 of a rotational bearing. The eccentricity is designated by E in FIGS. 3*a*, 3*b*. The rotational bearing, and therefore the die-plate carrier 11, can be actuated via a sealing-device lever 33 which is connected non-rotatably to a rotational shaft 31 (FIGS. 1 and 2) of the rotational bearing (for rotation in common).

As can be gathered from FIG. 2, a rocker 34 of the tensioning device is mounted rotatably at one end of the rotational shaft 31, which end lies opposite the transmission element 28. The rocker 34 is supported on the support 1 via a spring 35 (FIG. 3*a*). Since the rocker 34 is arranged on the same shaft as the sealing-device lever 33, the rotational axis 30, with which the sealing-device lever 33 causes the rotational shaft 31 to rotate, is aligned with a pivot axis of the rocker 34. Since, however, the rocker 34 is arranged on the rotational shaft with radial bearings (not shown in greater detail), rotational movements of the rotational shaft are decoupled from the pivoting movement of the rocker 34. Both the rotational axis 24 and the pivot axis coinciding with it run essentially-parallel to the bearing axis 14 of the die-plate carrier.

Figure 4:
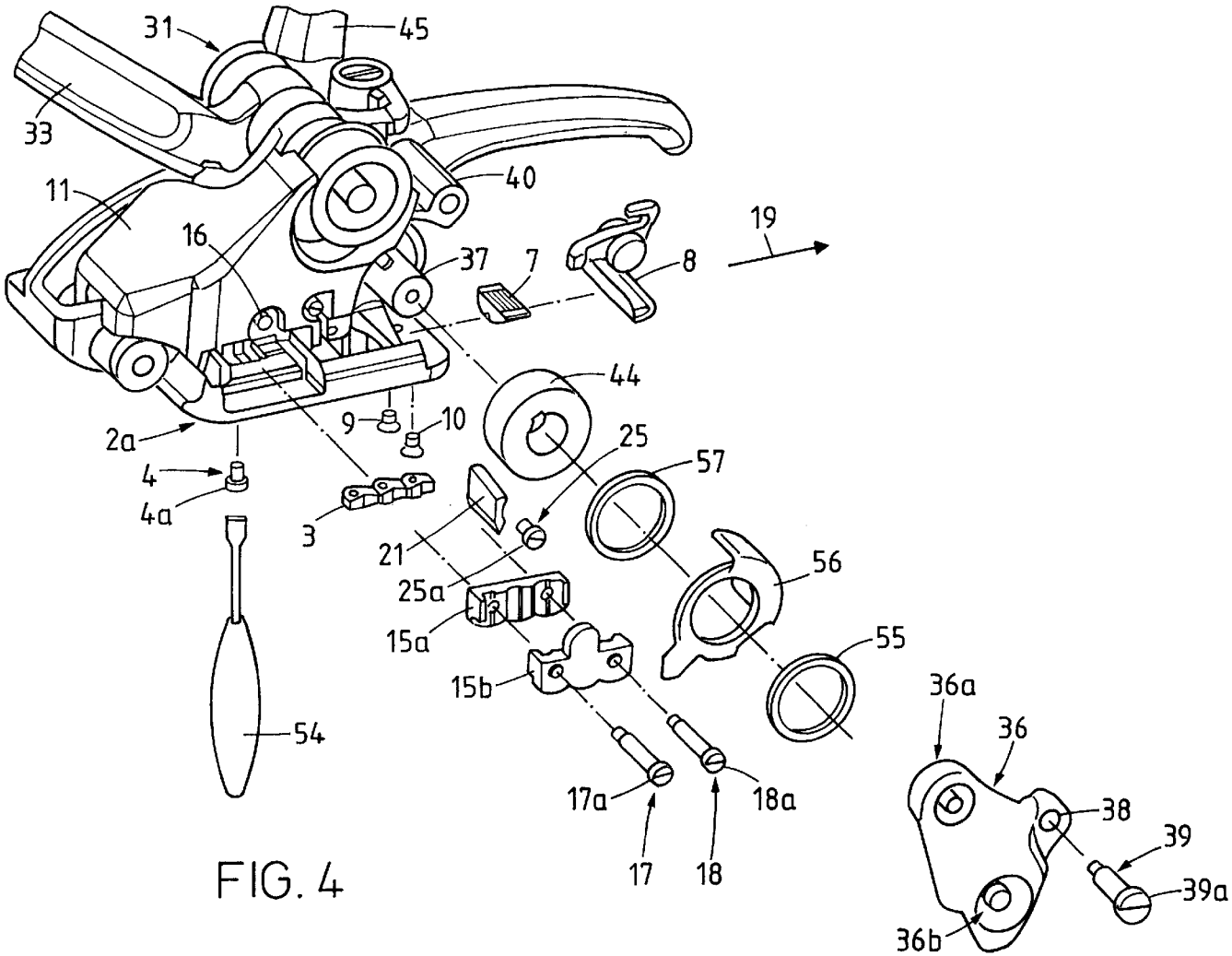
FIG. 4 shows a perspective exploded illustration of the strapping unit from FIG. 1.

The rocker 34 has, on the side of the die-plate carrier 11, a bearing plate 36 which is provided with a circular recess 36*a* and a peg 36*b* (FIGS. 2 and 4). The recess 36*a* is provided for arranging on one end of the rotational shaft 31 and of the peg 36*b* for pushing into the tensioning shaft 37. There is a passage hole 38 in the bearing plate 36, approximately between the recess 36*a* and the peg 36*b*, the said hole being used in order to fasten the bearing plate 34 with a set screw 39 to an internal thread of an extension 40 of the carrier. The slotted head 39*a* of the set screw 39 can, owing to the width and depth of the slot, also be actuated by the screwdriver with which the other screws 9, 10, 17, 18, 24, 25, 26 can also be loosened and tightened.

According to FIGS. 1 and 3*a*, a handle 41 is also connected fixedly to the rocker 34 and can be used to actuate the rocker 34 in the form of a pivoting movement around the rotational axis 30 or pivot axis. With the handle 41, the rocker 34 can be pivoted counter to the action of the compression spring 35 from a tensioning position (shown in the figures), in which a tensioning wheel 44 (FIG. 3*a*) bears against the toothed plate 7 or against a strap guided over the toothed plate 7, into a neutral end position (not shown in the figures) and back again into the tensioning position. In the neutral end position, the tensioning wheel 44 is arranged at a distance from the toothed plate 7. Without acting on the rocker 34, the latter always takes up the tensioning position on account of the spring force acting on it.

A tensioning lever 45, with which the tensioning wheel 44 (FIG. 3*a*) can be caused to rotate, is fitted to an end of the rocker 34 lying opposite the rotational axis 30 (FIG. 2). As can be seen in particular from FIG. 1 and FIG. 4, the tensioning shaft 37 is mounted rotatably in a cylindrical part 46 of the rocker 34. At the two ends of the tensioning shaft 37, the tensioning lever 45 is situated at one end and the tensioning wheel 44, which is arranged non-rotatably on the tensioning shaft 37 (for rotation in common), is situated at the other end. The tensioning lever 45 can be moved to and from a first end position into a second end position, in which case it is connected non-rotatably to the tensioning shaft 37 (for rotation in common) only in one direction of rotation. With regard to the other direction of rotation, there is no rotational connection to the tensioning shaft 37, and so the tensioning lever 45 can be moved back from its second end position into the first end position without carrying along the tensioning wheel 44 in the process. It is therefore possible to use the tensioning lever 45 to always move the tensioning wheel only in the tensioning direction.

In order, with the illustrated strapping unit according to the invention, to tension a strap loop around a packaged item 47 (which is illustrated schematically only in FIG. 7), first of all the strap 48 can be placed loosely around the packaged item 47, so that two strap layers 50, 51 lie one above the other in the region of the free strap end 49. The strapping unit is then arranged with its supporting surface 2*a* of the base plate 2 on the packaged item 47, the die-plate carrier 11 being arranged in its open end position and the tensioning wheel 44 being arranged in its neutral end position. As a result, the two strap layers 50, 51 lying one above the other can be guided over the base plate 2 of the strapping unit, so that the strap is situated between the die-plate 15 and the punch 3. By means of a pivoting movement of the rocker 34 counter to the spring force of the compression spring 35 a gap can then also be provided between the tensioning wheel 44 and the toothed plate 7. To this end, an operator can grasp the handle 41 and the sealing-device lever 33, which is arranged in its open end position, with one hand and compress the handle 41 upward in the direction of the sealing-device lever 33. After the two strap layers 50, 51 have been introduced into the gap, the handle 41 is released, as a result of which the compression spring 35 moves the rocker 34 back again toward the toothed plate 7 into its tensioning position. The two strap layers 50, 51 are thereby clamped in place between the tensioning reel 44 and the toothed plate 7. In the process, the lower strap layer 51 rests with the free strap end 49 on the punch 3 and on the bearing surface 2*b* of the base plate 2. The other strap layer 50 leading to a supply reel (not illustrated) is situated above the free strap end 49 and projects out of the strapping unit behind the tensioning wheel 44. This situation is shown in FIG. 7.

The strap loop can now be tensioned by actuation of the tensioning lever 45. For this purpose, the tensioning lever 45 is pivoted to and from a number of times between its two end positions. During its pivoting movement in the anticlockwise direction (with regard to the illustrations of FIGS. 3*a*, 3*b*, 7) the tensioning lever 45 is coupled to the tensioning wheel 44. The tensioning wheel 44 is therefore caused to rotate in the anticlockwise direction. By means of a frictional lock between the upper strap layer 50 and the tensioning wheel 44, the upper strap layer 50 is pulled further out of the strapping unit and the strap loop is provided with tension. In contrast, the lower strap layer 51 is retained unchanged in position by means of the profiling of the toothed plate 7. During the pivoting movement of the tensioning lever 45 in the clockwise direction, in contrast, the operative connection between the tensioning lever 45 and the tensioning wheel 44 is canceled. The tensioning wheel 44 therefore remains in its current rotational position. The oscillating movement of the tensioning lever is repeated until a sufficient tension has been applied to the strap.

The strap loop is subsequently sealed. For this purpose, the sealing-device lever 33 and the transmission element 28 are transferred from the open end position (FIG. 3*a*) into the sealing end position (FIG. 3*b*). In the exemplary embodiment illustrated, the sealing-device lever 33 covers a rotational angle $\alpha$ of approximately 140° in the process. The eccentrically mounted roller rolls here along the surface 27*c* of the receptacle 27. The eccentricity E of the transmission element 28 rotates here in the same direction of rotation as the sealing-device lever 33.

By this means, it is reliably ensured that an additive-free, i.e. in particular a lead-free and weld-free, seal is formed in the strap 48 itself by the die-plate 15 and the punch 3, which seal is not loosened even at high strap tension. Directly before the sealing end position is reached, the cutter 21*b* of the blade 21 notches into the upper strap layer 50, which is still connected to a strap supply, and severs it in the process from the strap supply. Subsequently, the sealing-device lever 33 can be transferred again into its open end position, the tensioning wheel can be lifted off the strap by actuation of the rocker 34 and the strapping unit can be removed from the strap loop, which is now finished, by guiding it away laterally.

After a multiplicity of such strapping operations, the components in contact with the strap 48 have to be changed due to wear. In this connection, the punch 3, which is inserted in the base plate 2, can be removed by releasing the slotted screw 4, which is accessible from the supporting side 2*a*, with the slotted screwdriver 54 and can be replaced by a new punch. In order to secure the new punch, the latter is to be placed under the two pins 5 and only the screw 4 is to be re-inserted. On account of the size of the screw head 4*a* or of the slot of the screw 4, a screwdriver 54 of size 4 can be used for this.

In order to swap the two parts 15*a*, 15*b* of the die-plate 15, the screws 17, 18, which are accessible from one side of the strapping unit have to be released. The slot width and depth of the heads 17*a*, 18*a* of the screws 17, 18 correspond to the head 4*a* of the screw 4, and so similarly the slotted screwdriver 54 of size 4 can be used for this purpose. The die-plate 15 can subsequently be removed from the pin 16 and swapped for a new die-plate. The latter is fastened again to the die-plate carrier 11 by means of the two screws 17, 18.

The blade 21 of the separating device can be pulled out of the die-plate carrier 11 after the slotted screw 25 is released. The same screwdriver 54 with which the screws 4, 17, 18 have also been actuated can also be used for this purpose. After a new blade 21 and, in order to fasten and adjust it, the screw 25 has been re-inserted, the adjusting screw 24 of the adjusting wedge 20 (FIG. 5) of the separating device can be adjusted with the same screwdriver 54. The slot width of this screw 24 also corresponds to the slot widths of the other screws 4, 17, 18. An additional tool is therefore not required either for the adjusting of the notch depth of the separating device.

In order to change the toothed plate 7 of the tensioning device, the two slotted screws 9, 10, which are accessible from the supporting side 2*a* of the base plate, have to be released. These screws 9, 10 have the same slot size as the screw 4 of the punch 3 and can therefore also be actuated with the same tool. After the screws 9, 10 have been released, the retaining plate 8 and the toothed plate 7 can be removed from the base plate 2 parallel to the tensioning direction (arrow 19). A new toothed plate and the previous retaining plate 8 are then inserted and the screws 9, 10 are again screwed into the base plate from the supporting side 2*a* by the screwdriver 54.

In order to swap the worn tensioning wheel 44 for a new tensioning wheel, the set screw 39 has to be released, the screwdriver 54 of size 4 likewise fitting into the slot of its screw head 39*a*. As can be gathered from FIG. 4, after that the bearing plate 36, a first spacer ring 55, a strap-guiding ring 56, a second spacer ring 57 and subsequently the tensioning wheel 44 can be removed from the tensioning shaft 37. After a new tensioning wheel has been pushed onto the tensioning shaft 37, the previously mentioned components can likewise be fitted again in the reverse order onto the tensioning shaft 37 and the bearing plate 36 can be fastened to the extension 40 by means of the screw 39.

What is claimed is:

1. A strapping unit for wrapping a tightening strap around an item to be packaged, said unit comprising:

a base plate having a supporting surface adapted to be placed on the packaged item;

a tensioning device for applying a tension to the tightening strap, said tensioning device having at least a first part adapted to be brought into contact with the strap during tensioning operation, the first part being releasably fastened to a remainder of the strapping unit by at least a first fastening element; and a sealing device for permanently connecting two layers of the tightening strap to each other, said sealing device having at least a second part adapted to be brought into contact with the strap during sealing operation, the second part being releasably fastened to a remainder of the strapping unit by at least a second fastening element;

wherein each of said first and second fastening elements has an engagement portion adapted to engage with a matching portion of an external driving tool, and the engagement portions of the first and second fastening elements are identical, so that the first and second fastening elements can be fastened or unfastened using the same driving tool.

2. The strapping unit of claim 1, further comprising a cutting device for cutting the strap, said cutting device having at least a third part adapted to be brought into contact with the strap during cutting operation, the third part being releasably fastened to a remainder of the strapping unit by at least a third fastening element that has an engagement portion identical to the engagement portions of the first and second fastening elements, so that the first, second and third fastening elements can be fastened or unfastened using the same driving tool.

3. The strapping unit according to claim 1, wherein the second part of said sealing device includes a die-plate and a punch between which two layers of the strap can be arranged and notched, said die-plate being releasably fastened to said base plate by at least one said second fastening element.

4. The strapping unit according to claim 1, wherein said punch is releasably fastened to a moveable part of said strapping unit, which moveable part is lowerable on said die-plate, by at least another one said second fastening element.

5. The strapping unit according to claim 1, wherein the first part of said tensioning device includes a tensioning wheel fitted over a tensioning shaft of said tensioning device, said tensioning wheel being restrained from axially moving along said tensioning shaft by at least one said first fastening element.

6. The strapping unit according to claim 5, wherein the first part of said tensioning device further includes a toothed plate being releasably fastened to said base plate by at least another one said first fastening element.

7. The strapping unit according to claim 2, wherein the third part of said cutting device further includes a blade being releasably fastened to a moveable part of said strapping unit, which moveable part is lowerable on said die-plate, by at least one said third fastening element.

8. The strapping unit according to claim 7, wherein the second part of said sealing device includes a die-plate and a punch between which two layers of the strap can be arranged and notched, said die-plate being releasably fastened to said base plate by at least one said second fastening element, said punch is releasably fastened to said moveable part by at least another one said second fastening element; and the first part of said tensioning device includes a tensioning wheel fitted over a tensioning shaft of said tensioning device and a toothed plate, said tensioning wheel being restrained from axially moving along said tensioning shaft by at least one said first fastening element, said toothed plate being releasably fastened to said base plate by at least another one said first fastening element.

9. The strapping unit according to claim 1, wherein the first and second fastening elements are screws that have slots of the same size so that the screws can be fastened or unfastened by means of just one screwdriver.

10. The strapping unit according to claim 1, wherein the engagement portions of all said first and second fastening elements are accessible to the matching portion of the driving tool from the outside of said strapping unit, without other components of the strapping unit having to be removed for this purpose.

11. A strapping unit for wrapping a tightening strap around an item to be packaged, said unit comprising:

a base plate having a supporting surface adapted to be placed on the packaged item;

a tensioning device for applying a tension to the tightening strap;

a sealing device for permanently connecting two layers of the tightening strap to each other; and a cutting device for cutting the strap; wherein each of said base plate, tensioning device, sealing device and cutting device has at least a part adapted to be operatively brought into contact with the strap during tensioning, sealing or cutting the strap, said part being releasably fastened to a remainder of said strapping unit solely by one or more fastening element having an engagement portion adapted to engage with a matching portion of an external driving tool; and the engagement portions of all said fastening elements of said parts of said base plate, tensioning device, sealing device and cutting device, are identical, thereby allowing said parts to be removed for replacement or maintenance by unfastening and removal of the respective fastening elements using the same driving tool.

12. The strapping unit according to claim 11, wherein the engagement portions of all said fastening elements of said parts are accessible from the outside of said strapping unit, thereby allowing said parts to be removed for replacement or maintenance, without other components of the strapping unit having to be removed for this purpose.

* * * * *